United States Patent [19]

Reist

[11] Patent Number: 4,801,132

[45] Date of Patent: Jan. 31, 1989

[54] METHOD AND APPARATUS PROCESSING PRINTED PRODUCTS

[75] Inventor: Walter Reist, Hinwil, Switzerland

[73] Assignee: Ferag AG, Hinwil, Switzerland

[21] Appl. No.: 915,261

[22] Filed: Oct. 3, 1986

[30] Foreign Application Priority Data

Oct. 23, 1985 [CH] Switzerland ..... 04558/85

[51] Int. Cl.[4] ..... B65H 5/30

[52] U.S. Cl. ..... 270/55; 271/187; 271/315; 271/204; 198/470.1

[58] Field of Search ..... 270/54–58; 271/187, 315, 304, 277, 83, 300, 306, 295, 296; 198/470.1, 803.7, 803.9

[56] References Cited

U.S. PATENT DOCUMENTS

| | | | |
|---|---|---|---|
| 2,355,697 | 8/1944 | Belluche | 271/306 |
| 3,122,362 | 2/1964 | Vollrath et al. | 270/57 |
| 3,450,400 | 6/1969 | Guggisberg | 270/55 |
| 3,951,399 | 4/1976 | Reist | 270/55 |
| 4,039,182 | 8/1977 | Reist et al. | 271/204 |
| 4,058,202 | 11/1977 | Reist et al. | 270/55 |
| 4,565,363 | 1/1986 | Faltin | 271/315 |

FOREIGN PATENT DOCUMENTS 370423 8/1963 Switzerland .

*Primary Examiner*—Eugene H. Eickholt
*Attorney, Agent, or Firm*—Werner W. Kleeman

[57] ABSTRACT

A circulatingly driven processing drum comprises radially arranged, outwardly open compartments into which there are to be introduced printed products. These printed products are delivered in a suspended orientation. A substantially linear, horizontally oriented transporting or conveying arrangement serves this purpose. This transporting or conveying arrangement has grippers arranged at predetermined intervals which hold the printed products at the upper end of their side edges. Below the transporting or conveying arrangement and ahead or upstream of the processing drum or cylinder there is arranged at least on circulatingly driven conveyor belt which contacts the lower side edges of the printed products, thus stabilizing the printed products in their suspended orientation. The delivered printed products are introduced with their lower side edges leading into the compartments of the processing drum or cylinder. Delivering the printing products in a vertically suspended position permits high processing speeds.

12 Claims, 2 Drawing Sheets

METHOD AND APPARATUS PROCESSING PRINTED PRODUCTS

BACKGROUND OF THE INVENTION

The present invention broadly relates to a new and improved method of and apparatus for processing printed products.

In its more specific aspects the present invention broadly relates to a new and improved method of and apparatus for processing printed products and, in particular, folded printed products or signatures.

Generally speaking, the apparatus of the present invention comprises at least one circulatingly drivable processing drum or cylinder having a highest point or apex and the processing drum, or cylinder comprises radially arranged, outwardly open compartments.

The method of the present invention serves for loading such processing drum or cylinder.

An apparatus of this general type for processing printed products has already been described in the German Patent Publication No. 2,447,336, essentially corresponding to the subject matter of the U.S. Pat. No. 3,951,399, and which comprises a circulatingly drivable processing drum rotatable about its horizontal axis. Several transporting or conveying means for printed products, arranged substantially in parallel with respect to each other, are located with respect to this processing drum in elevated and transversely positioned relationship.

These transporting or conveying means are also substantially transversely positioned with respect to the rotational axis of the processing drum. Each transporting or conveying means comprises a transport or feed device with a circulatingly driven traction arrangement and possesses grippers affixed thereon for holding individual printed products, and is further subdivided into two superimposed sections or runs. Along the upper section or run the printed products are moved in a linear motion, while positioned in an imbricated, partially superimposed or overlapping formation on the conveyor system. The direction of feeding is reversed as compared to the rotational direction of the processing drum.

At the end of this first section or run the transport or feed device is guided over a deflection wheel or roll, is deflected by 180° and is returned along the lower section or run. Within this second, no longer linear section or run, which instead has a curved course in accordance with the curvature of the processing drum, the feeding direction of the transport or feed device is in opposition to that of the superimposed first section or run. At a predetermined distance from and surrounding the deflection wheel or roll there is located a radially formed guiding plate or shield, used for simultaneously deflecting and guiding the printed products along their leading edges. During this deflection process the printed products, which are still held by the grippers at their trailing edges, are moved into a position which is, with respect to the feeding direction, forwardly inclined. The printed products are introduced into the compartments of the processing drum while in this inclined position. During the introduction of each respective printed product, the compartment exhibits substantially the same inclination as the related printed product. The lower section or run of the conveyor system is, as previously mentioned, constructed in a radial fashion, such that the printed products are increasingly raised from their inclined positions, until finally reaching a vertically suspended position. Thus, during this erecting process the printed products are maintained in positions corresponding to the continuously changing and increasingly vertical positions of the respective compartments of the processing drum.

As soon as the printed products have reached a vertical hanging or suspended position, the holding grippers open and release the printed products, permitting them to fall into the associated compartment.

This known arrangement thus comprises rather extensive constructive measures for bringing the printed products into a suitably inclined position or orientation aligned with the compartments, and permitting the proper, undamaged introduction of the printed products into these compartments.

In addition, Swiss Patent No. 370,423 describes a construction for processing printed products by means of feeding folded, printed products with their folded leading edges into receiving compartments or pockets of an intermediate conveyor. These circulating compartments are fastened to a rotatingly circulating chain. An auxiliary conveyor is provided for adding enclosures or inserts to the opened folded printed products within the receiving compartments. For this purpose, the auxiliary conveyor is arranged above the upper, horizontal run of the chain which carries the receiving compartments substantially parallel to this chain run.

The enclosures or inserts are held by the grippers of the auxiliary conveyor at their upper edges and are guided in a suspended position or orientation and in the same direction of motion to a location above the receiving compartments. The auxiliary conveyor is arranged at a predetermined distance above the intermediate conveyor or, respectively, the receiving compartments. The aforementioned distance is greater than the height of the enclosures or inserts. These enclosures or inserts fall into the opened printed products within the receiving compartments as soon as they are released by the grippers.

In this construction, the auxiliary conveyor and the receiving compartments are located parallel to each other in a predetermined region in order to bring the enclosures or inserts into a hanging position or suspended orientation aligned with the vertically positioned, upwardly open receiving compartments, ready to be released. The enclosures or inserts reach the receiving compartments in free fall, which limits reliable introduction into the receiving compartments to low conveying speeds.

SUMMARY OF THE INVENTION

Therefore, with the foregoing in mind, it is a primary object of the present invention to provide a new and improved method of and an apparatus for processing printed products which do not exhibit the aforementioned drawbacks and shortcomings of the prior art constructions.

A further significant object of the present invention is directed to providing a new and improved method of and apparatus for processing printed products which permit achieving by simple constructive measures an increase in processing speed and reliably and safely transporting the printed products into the compartments of a processing drum or cylinder.

Now in order to implement these and other objects of the present invention which will become more readily apparent as the description proceeds, the method of the present development is manifested by the features that at least one circulatingly drivable, and with respect to a processing drum, elevated and transversely positioned, conveying means is provided for delivering the printed products to radially arranged, outwardly open compartments of the processing drum in a substantially suspended configuration and in a linear substantially horizontally oriented direction. The conveying means is also provided for introducing the printed products into the compartments of the processing drum with a lower side edge thereof leading, such that a path of motion of the lower side edges of the printed products passes below the highest point or apex of the processing drum.

In the method used for processing printed products the printed products to be processed are delivered to radially arranged, outwardly open compartments of the processing drum or cylinder by means of a circulatingly driven and with respect to the processing drum, elevated and transversely positioned transporting or conveying means.

In accordance with the invention, the printed products are transported substantially vertically suspended, in a substantially linear motion, and submerge or descend with their lower leading edges into the compartments, while still in an inclined orientation with respect to a vertical reference datum, i.e., before the compartments have reached their most vertical position or orientation. Immediately upon entering the compartments, the lower leading edge of each printed product hits or strikes the trailing wall of the respective compartment and is supported thereby. While the printing products remain supported by the trailing walls during the transporting process, the continuous forward motion brings them within the limiting or bounding edge of the leading compartment wall for support, since at that instant the horizontal conveying speed of the printed products is still higher than the horizontal speed component of the respective compartment, i.e., higher than the speed in the transporting or conveying direction of the printed products. Thus, the printed products, soon after entering a compartment, are supported at two separate locations, which assures that the printed products can enter in and remain within the compartments without being damaged, even with very high transporting or conveying speeds, and thus correspondingly high rotary speeds of the processing drum.

At the highest point or apex of the processing drum or cylinder, i.e. where the compartments approach a vertical position or orientation, the aforementioned support of the printed products by the compartment walls is no longer present to the previous extent. This, however, is of no consequence, because the printed products in this particular drum position have already descended sufficiently far into the compartments that such support becomes superfluous.

Since the printed products are conveyed along a linear, substantially horizontal transporting or conveying direction, no bends or curved sections are required within the transporting or conveying system at the region of the processing drum, thus avoiding complicated constructions of the transporting or conveying installation and thus problems of wear and rough operation.

Under certain circumstances it may be advantageous, or even become essential, to stabilize the printed products in their suspended position or orientation before their introduction into the compartments of the processing drum. For this purpose a support system may be arranged ahead of the processing drum such that the printed products are supported on their lower side edges for guidance during their passage through the transporting or conveying path.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof only enough of the structure of the apparatus for processing printed products has been illustrated therein as is needed to enable one skilled in the art to readily understand the underlying principles and concepts of the present invention.

Figure 1:
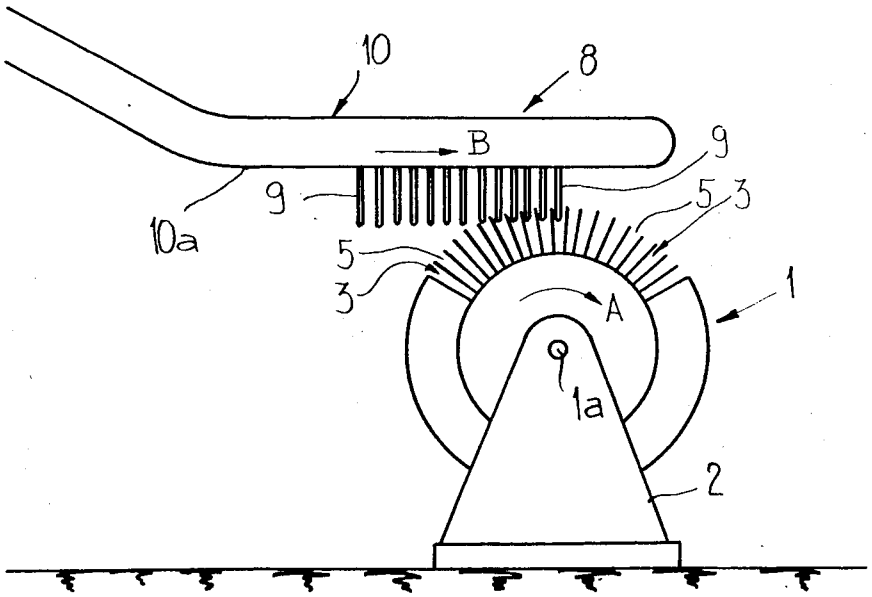
FIG. 1 shows a side view of an apparatus for processing printed products comprising a processing drum and a transporting or conveying means for printed products.

Turning now specifically to FIG. 1 of the drawings, the inventive means for processing printed products illustrated therein by way of example and not limitation and employed to realize the method as hereinbefore described will be seen to comprise a processing drum or cylinder designated with the reference numeral 1, and of the same general type as shown in the aforementioned German Patent Publication No. 2,447,336, essentially corresponding in subject matter to the likewise aforementioned U.S. Pat. No. 3,951,399, and in the German Patent Publication No. 2,604,101, essentially corresponding in subject matter to the U.S. Pat. No. 4,058,202, and described in detail therein. The construction and operating principles of such a processing drum or cylinder are described in these publications, the disclosure of which is thus incorporated herein by reference. The processing drum 1 is rotationally suspended in a frame or stand 2 and it is rotationally driven about its horizontal, longitudinal axis 1*a* in the sense of the arrow A. The processing drum 1 comprises radially arranged compartments 3 which are closed off at their lower sides by a bottom or floor 4 (FIG. 2) and are open at the periphery of the processing drum 1. The corresponding opening of each of the compartments 3 is designated by the reference numeral 5. Each compartment 3 comprises a trailing wall 6, as viewed in the sense of the rotational motion A, as well as a leading wall 7, also as viewed in the sense of this rotational motion A.

Above the processing drum 1 there are arranged, substantially parallel to each other and transverse to the rotational axis 1*a* of the processing drum 1, transporting or conveying means for printing products, such as are known, for instance, from the description in the hereinbefore mentioned German Patent Publication No.

2,447,336, essentially corresponding in subject matter to the U.S. Pat. No. 3,951,399.

Figure 2:
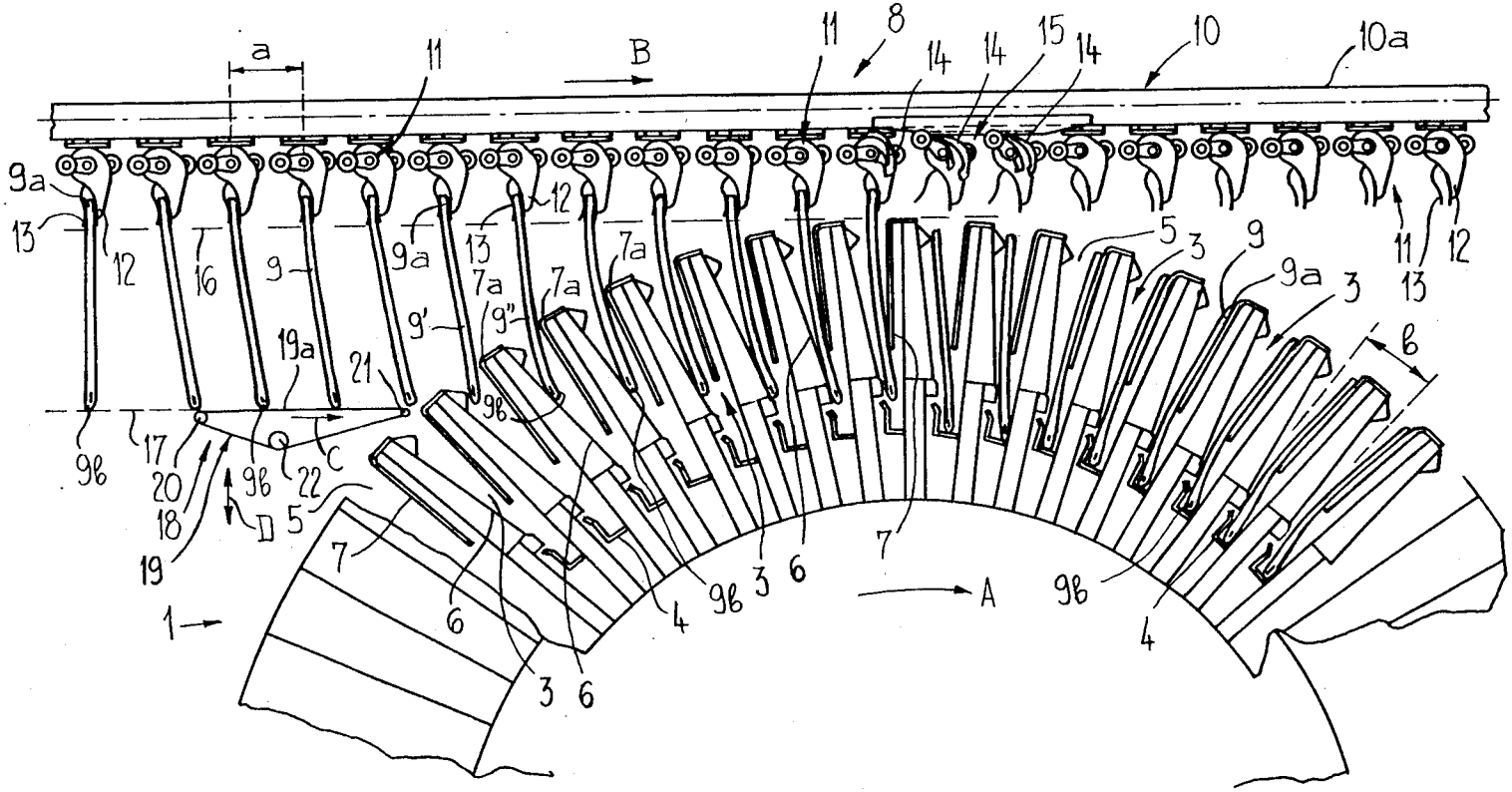
FIG. 2 shows a side view, on an enlarged scale in comparison to FIG. 1, of the upper portion of the processing drum as well as the transporting or conveying means within the transfer area.

Of these transporting or conveying means, which are substantially identical in construction, FIGS. 1 and 2 show a first transporting or conveying means 8 for printed products 9, which are considered to be folded principal or main printed products such as folded sheets or signatures. These transporting or conveying means 8 (as well as all other such transporting or conveying means) comprise a guiding channel 10, of which the section or run 10*a* located above the processing drum 1 is arranged in a substantially linear and horizontal orientation. This substantially linear section 10*a* begins ahead or upstream of the processing drum 1, as is shown in FIG. 1. Within this guiding channel 10 there is arranged a circulatingly driven traction member, revolving or circulating in the direction of the arrow B. This traction member may be a chain with grippers or clamps 11 attached at regular intervals. The distance or spacing between successive grippers 11, i.e. the linear pitch, is arranged such that it coincides with the distance or spacing b between the compartments 3 of the processing drum 1 (FIG. 2) which defines an angular pitch. The construction of the grippers or clamps 11 corresponds, for instance, to the description of the grippers or clamps of the German Patent Publication No. 3,102,242, essentially corresponding in subject matter to the U.S. Pat. No. 4,381,056, the subject matter of which is also incorporated herein by reference. Each gripper 11 comprises a stationary jaw 12 as well as a movable jaw 13 which can be locked by locking elements 14 in its clamped state for holding, conjointly with the stationary jaw 12, a printed product 9.

The printed products 9 are held tightly at their upper side edges 9*a* between the clamping jaws 12 and 13 and are transported in a substantially vertically suspended position or orientation in the direction B to the processing drum 1. The lower side edge 9*b* of each printed product 9 is formed by the folded or spine edge. Substantially vertically above the rotational axis 1*a* of the processing drum 1, e.g., within the region of the highest point or apex thereof, there is arranged a control curvature or camming profile or cam 15 for opening the grippers or clamps 11. Upon passage of the grippers 11 along this control curvature or cam 15, the locking elements 14 are actuated, which causes each movable clamping jaw 13, which is spring loaded or biased, to snap open, thus causing the printed products to be released.

The linear section 10*a* of the guiding channel 10 is arranged at a predetermined distance above the processing drum or cylinder 1, such that the lower side edges 9*b* of the transported printed products 9 are positioned below a tangential plane 16 indicated in dashed lines in FIG. 2 which is located parallel to the transport direction B of the printed products 9 and extending tangentially to the processing drum 1. The trajectory described by the lower side edges 9*b* of the printed products 9, situated below the tangential plane 16, is designated by the numeral 17 and is indicated by a dashed line.

As seen in the transporting or conveying direction B of the printed products 9, there is arranged upstream of the processing drum 1 a support system or support device 18 for the transported or conveyed printed products 9. This support system or support device 18 is formed by at least one conveyor belt 19 circulatingly driven in the direction of arrow C and which is guided by means of deflecting and driving rolls 20, 21 and 22. The upper run 19*a* of the conveyor belt 19 is substantially aligned in parallel to the direction of motion of the printed products 9 comparable to the direction of motion B of the driven traction member, and is arranged at a predetermined height such that the suspended printed products 9 contact the horizontal run 19*a* of the conveyor belt 19 with their lower side edges 9*b*. The drive speed of the conveyor belt 19 is substantially the same as, or slightly higher than, the transporting or conveying speed of the transporting or conveying means 8. This means that the lower side edges 9*b* which are in contact with the conveyor belt 19 are moved with substantially the same speed as, or with a slightly higher speed than, the speed of the grippers 11 holding the upper side edges 9*a* of the printed products 9. In this manner the printed products 9 are stabilized in their suspended position or orientation, which guarantees that the printed products 9 are delivered to the processing drum 1 in a precisely defined, substantially vertical position or orientation. The support system or device 18 is extensible and retractable in the direction of the double-headed arrow D for adjusting the distance to the grippers 11 such that the height can be adjusted to match the size of the printed products 9.

The support system or device 18 can be particularly useful at high feeding rates of the conveying means 8 and is capable of handling even relatively stiff and bulky products at more moderate processing speeds. The suspended printed products 9 moving along a substantially straight horizontal extending transporting or conveying path towards the processing drum 1 at a feeding or feed rate which is adapted to match the rotary speed of the processing drum 1 contact the conveyor belt 19 with their lower side edges 9*b*, and thus are stabilized in their suspended orientation. After leaving the conveyor belt 19 each printed product submerges or descends with its lower side edge 9*b* into a related compartment 3 of the processing drum 1, as is demonstrated by the printed product 9' shown in FIG. 2. Shortly after entering a compartment 3, each printed product 9 contacts the rear or trailing compartment partition wall 6, as is demonstrated by the printed product 9'', also shown in FIG. 2. Thus, the printed products 9 are initially supported at a first location. During their continued travel in the direction B, the printed products 9 are also deposited within the area of the edge 7*a* of the leading partition wall 7, which edge forms the boundary to the infeed opening or aperture 5, since at this instant the conveying speed of the printed products 9 is still higher than the horizontal speed component of the corresponding compartment 3 in a horizontal direction parallel to the transporting or conveying direction B. Thus the printed products 9 are now supported at two separate locations, namely the entrance edge 7*a* and the rear or trailing compartment wall 6.

This method of supporting the printed products 9 at two separate locations stabilizes these printed products 9 in their position and prevents fluttering thereof within the compartment 3, such that any danger of damage to or excursion of the printed products 9 from the compartment 3 is eliminated. While continuing the forward movement in the transporting direction B the printed products 9 penetrate deeper into the compartments 3 each of which gradually approaches its uppermost, substantially vertical position or orientation. Whenever a compartment 3 assumes a vertical position, the related gripper or clamp 11 opens as hereinbefore described, thus releasing the related printed product 9, which consequently falls downwardly until its side edge **9*b* reaches the bottom or floor 4 of the compartment 3**.

The printed products 9 which are now fully located within the compartments 3 are moved forward along their lateral axis and spread or opened during the rotation of the processing drum 1. This permits the insertion of enclosures or auxiliary products or inserts into the opened principal or main printed products 9. The enclosures or inserts may be infed or delivered by means of a conveying system which generally corresponds to the transporting or conveying system or means 8. For details of opening and closing the printed products 9, and for inserting auxiliary products or enclosures or inserts reference is made to the hereinbefore mentioned German Patent Publications No. 2,447,336 and No. 2,604,101 essentially corresponding in subject matter to the respective U.S. Pat. No. 3,951,399 and U.S. Pat. No. 4,058,202.

It is also feasible to transport the printed products 9, in certain cases, to the processing drum 1, such that in place of the folded edge **9*b* the fan edge 9*a*** forms the lower side edge.

While there are shown and described present preferred embodiments of the invention, it is to be distinctly understood that the invention is not limited thereto, but may be otherwise variously embodied and practiced within the scope of the following claims. Accordingly,

What I claim is:

1. A method of processing printed products, comprising the steps of:

delivering the printed products to be processed to radially arranged, outwardly open compartments of a processing drum by means of a circulatingly driven conveying means elevated and transversely positioned relative to said processing drum;

said step of delivering the printed products entailing delivering the printed products to said processing drum in a substantially suspended configuration and in a linear, essentially horizontally oriented direction;

introducing the printed products with lower side edges thereof leading into said radially arranged, outwardly open compartments of said processing drum;

said step of introducing the printed products entailing introducing the printed products such that a path of motion of said lower aide edges of the printed products passes below a highest point of said processing drum; and said step of introducing the printed products with lower side edges of thereof leading into said radially arranged, outwardly open compartments of said processing drum further entails introducing each printed product into an associated one of said compartments such that each said printed product at least at some point in time during introduction thereof into the associated compartment is supported at two separate and oppositely situated locations of the associated compartment.

2. The method as defined in claim 1, wherein:

said step of delivering the printed products in a substantially suspended configuration to said processing drum entails guiding the printed products at said lower side edges thereof upstream of said step of introducing the printed products into said drum.

3. The method as defined in claim 1, wherein:

said step of delivering the printed products to said processing drum entrails delivering the printed products individually freely suspended at upper side edges thereof and substantially transverse to said linear, essentially horizontally oriented direction.

4. The method as defined in claim 1, wherein; said lower side edges are defined by folded edges.

5. The method as defined in claim 1, wherein: said lower side edges are defined by fan edges.

6. The method as defined in claim 1, wherein:

said step of introducing the printed products with lower side edges thereof leading into said radially arranged, outwardly open compartments of said processing drum entailing introducing each of said printed products in said substantially suspended configuration into an associated compartment in a product direction of extent which differs from the direction of extent of the radially arranged associated compartment during introduction of the printed product into such associated compartment.

7. An apparatus for processing printed products, comprising;

at least one processing drum circulatingly drivable about a substantially horizontal axis of rotation and having a highest point;

said at least one processing drum comprising radially arranged, outwardly open compartments;

at least one circulatingly drivable, and with respect to said at least one processing drum, elevated and transversely positioned conveying means for delivering the printed products to said radially arranged, outwardly open compartments of said at least one processing drum in a substantially suspended configuration and in a linear, essentially horizontally oriented transporting direction, and for introducing said printed products with lower side edges thereof leading into said radially arranged, outwardly open compartments of said at least one processing drum such that a path of motion of said lower side edges of the printed products passes below said highest point of said at least one processing drum;

each of said radially arranged, outwardly open compartments having oppositely situated walls; and said at least one circulatingly drivable conveying means introducing each of said printed products into an associated compartment such that at some point in time during introduction of each printed product into an associated compartment said introduced printed product is simultaneously supported at said oppositely situated walls of the associated compartment.

8. The apparatus as defined in claim 7, wherein:

said at least one circulatingly drivable and elevated and transversely positioned conveying means possesses a substantially linear and essentially horizontal transport direction in a region thereof preceding said at least one processing drum;

said at least one processing drum having a predetermined direction of circulation; and said substantially linear and essentially horizontal transport direction and said predetermined direction of circulation having the same sense.

9. The apparatus as defined in claim 7, wherein:

said radially arranged, outwardly open compartments are spaced apart in an angular pitch; and said at least one circulatingly drivable and elevated and transversely positioned conveying means being provided with individually releasable grippers arranged in a predetermined mutual spaced relationship defining a linear pitch corresponding to said angular pitch of said radially arranged outwardly open compartments for gripping the printed products individually on upper side edges thereof extending transversely to said substantially linear and, essentially horizontal transport direction.

10. The apparatus as defined in claim 7, wherein:

the printed products have lower side edges; and support means preceding said at least one processing drum in said substantially linear and essentially horizontal transport direction for guiding the printed products on said lower side edges during conveyance thereof.

11. The apparatus as defined in claim 9, wherein:

said at least one processing drum has a longitudinal axis; and releasing means arranged above said longitudinal axis of said at least one processing drum for opening said individually releasable grippers.

12. An apparatus for processing printed products, comprising:

at least one processing drum circulatingly drivable about a substantially horizontal axis of rotation and having a highest point;

said at least one processing drum comprising radially arranged, outwardly open compartments;

at least one circulatingly drivable, and with respect to said at least one processing drum, elevated and transversely positioned conveying means for delivering the printed products to said radially arranged, outwardly open compartments of said at least one processing drum in a substantially suspended configuration and in a linear, substantially horizontally oriented transporting direction, and for introducing said printed products with lower side edges thereof leading into said radially arranged, outwardly open compartments of said at least one processing drum such that a path of motion of said lower side edges of the printed products passes below said highest point of said at least one processing drum;

the printed products having lower side edges;

support means preceding said at least one processing drum in said substantially linear and substantially horizontal transport direction for guiding the printed products on said lower side edges during conveyance thereof;

said support means comprising at least one circulatingly driven conveyor belt arranged for circulation in the same sense as said substantially linear and substantially horizontal transport direction of said conveyor device; and said at least one circulatingly driven conveyor belt having a upper run extending substantially parallel to said substantially linear and substantially horizontal transport direction for supporting said lower side edges of the printed products.

* * * * *